US005535882A

United States Patent [19]

Liu

[11] Patent Number: 5,535,882

[45] Date of Patent: Jul. 16, 1996

[54] HANDY TOOL CASE

[76] Inventor: Lai-Ho Liu, No. 8, Taming Lane, Hsinkuang Rd.,Taiping Hsiang, Taichung Hsien, Taiwan

[21] Appl. No.: 452,093

[22] Filed: May 26, 1995

[51] Int. Cl.[6] ..... B65D 85/28

[52] U.S. Cl. ..... 206/377; 206/376; 206/379; 206/818; 211/70.6; 211/69; 224/680; 224/666; 224/679; 224/681

[58] Field of Search ..... 206/373, 378, 206/379, 818, 376, 377; 211/69, 70.6; 224/252

[56] References Cited

U.S. PATENT DOCUMENTS

| | | | |
|---|---|---|---|
| 1,726,718 | 9/1929 | Rice | 206/378 |
| 4,880,122 | 11/1989 | Martindell | 211/69 |
| 4,928,823 | 5/1990 | Campbell | 206/818 |
| 4,930,628 | 6/1990 | Bridges | 206/378 |
| 5,006,066 | 4/1991 | Rouse | 206/379 |
| 5,108,287 | 4/1992 | Yee et al. | 206/379 |
| 5,133,455 | 7/1992 | Chow | 206/373 |

*Primary Examiner*—David T. Fidei
*Attorney, Agent, or Firm*—Bacon & Thomas

[57] ABSTRACT

A handy tool case including a case body, which has a plurality of hexagonal chambers at the top side for keeping tool bits, a clip at the back side for hanging on the user's belt, two springy hooks at the bottom side for keeping a tool handle outside the case body, and a platform at the front side, a cover pivoted to the case body and turned between the close position covered over the tool bits in the hexagonal chambers and the open position supported on the platform, and a plurality of magnetic plates fitted into respective recessed portions inside the cover for keeping metal accessories by magnetic attraction.

1 Claim, 5 Drawing Sheets

HANDY TOOL CASE

BACKGROUND OF THE INVENTION

The present invention relates to tool cases, and relates more particularly to such a handy tool case which can be hung on the user's belt to carry a tool handle and a set of tool bits.

Various hand tools, such as screw drivers, socket wrenches, etc., have been developed for turning or driving different mechanical parts. Furthermore, different tool bits may be alternatively attached to a common tool handle for turning or driving different mechanical parts. In order to keep different hand tools and tool bits in order, a tool case or like means shall be used. FIG. 1 shows a tool case according to the prior art, which is comprised of two symmetrical shells hinged together, each shell defining a variety of compartments for keeping different tool parts. This and other conventional tool cases can keep different tools and tool parts in good order, however they still have drawbacks. Because conventional tool cases are commonly heavy and huge, they are not convenient to carry with oneself. When to change the tool bit from the tool handle, the user shall have to go to the place in which tool case is placed, to pick up the desired tool bit for a change. Another drawback of conventional tool cases is that the user tends to leave the tool handle or the tool bits at the working place because the tool cases cannot be carried on the user's body while the user is working. Still another drawback of conventional tool cases is that they have no means to hold accessories which are dismantled from machines.

SUMMARY OF THE INVENTION

The present invention has been accomplished to provide a handy tool case which eliminates the aforesaid drawbacks. It is one object of the present invention to provide a handy tool case which can be hung on the user's belt to carry a tool handle and a set of tool bits for convenient use. It is another object of the present invention to provide a handy tool case which has means to hold accessories which are dismantled from machines. To achieve these and other objects of the present invention, there is provided a handy tool case comprised of a case body, which has a plurality of hexagonal chambers at the top side for keeping tool bits, a clip at the back side for hanging on the user's belt, two springy hooks at the bottom side for keeping a tool handle outside the case body, and a platform at the front side, a cover pivoted to the case body and turned between the close position covered over the tool bits in the hexagonal chambers and the open position supported on the platform, and a plurality of magnetic plates fitted into respective recessed portions inside the cover for keeping metal accessories by magnetic attraction.

DETAILED DESCRIPTION OF THE PREFERRED EMBODIMENT

Figure 1:
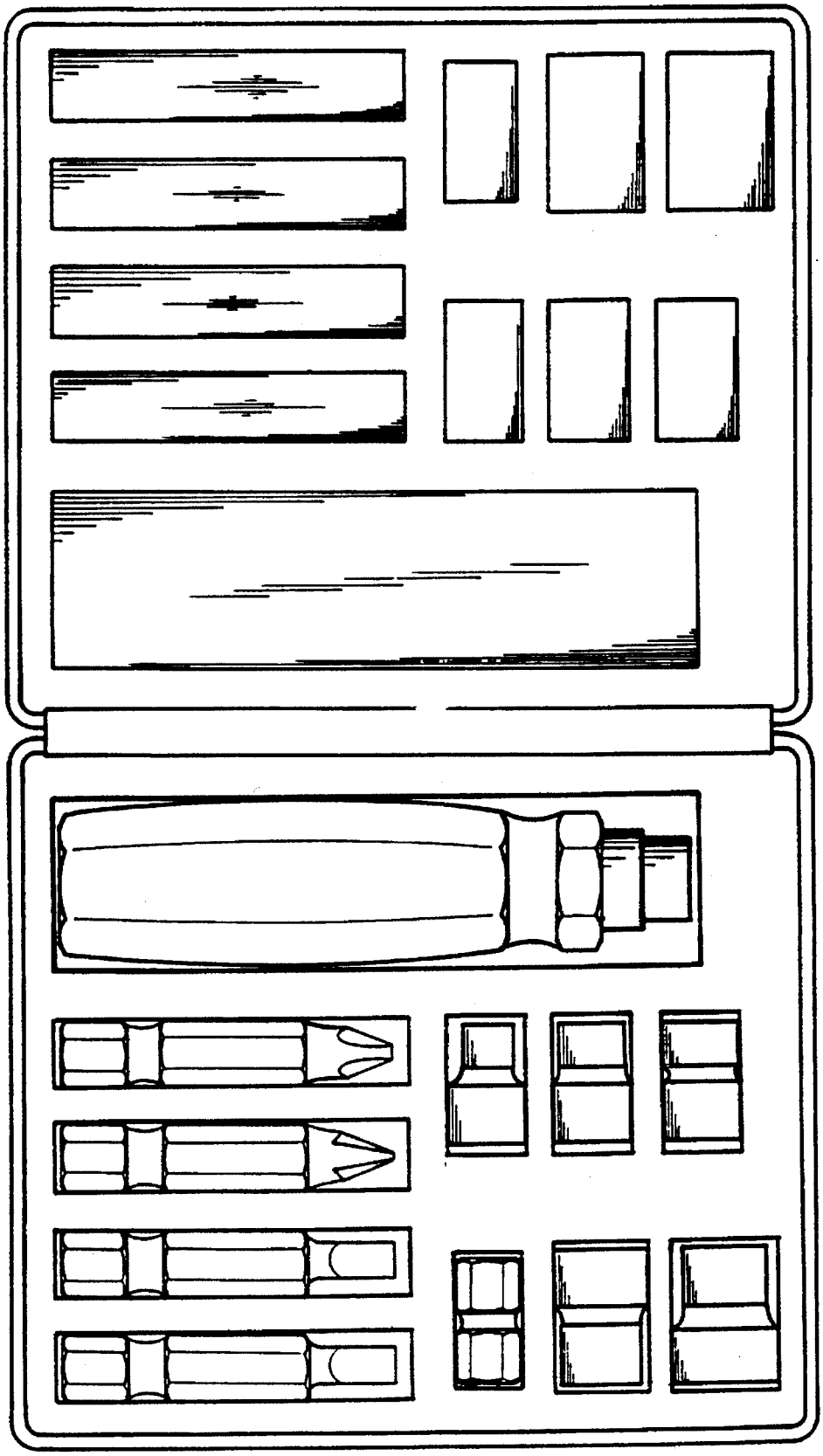
FIG. 1 (PRIOR ART)
FIG. 1 shows a tool case according to the prior art.
Figure 2:
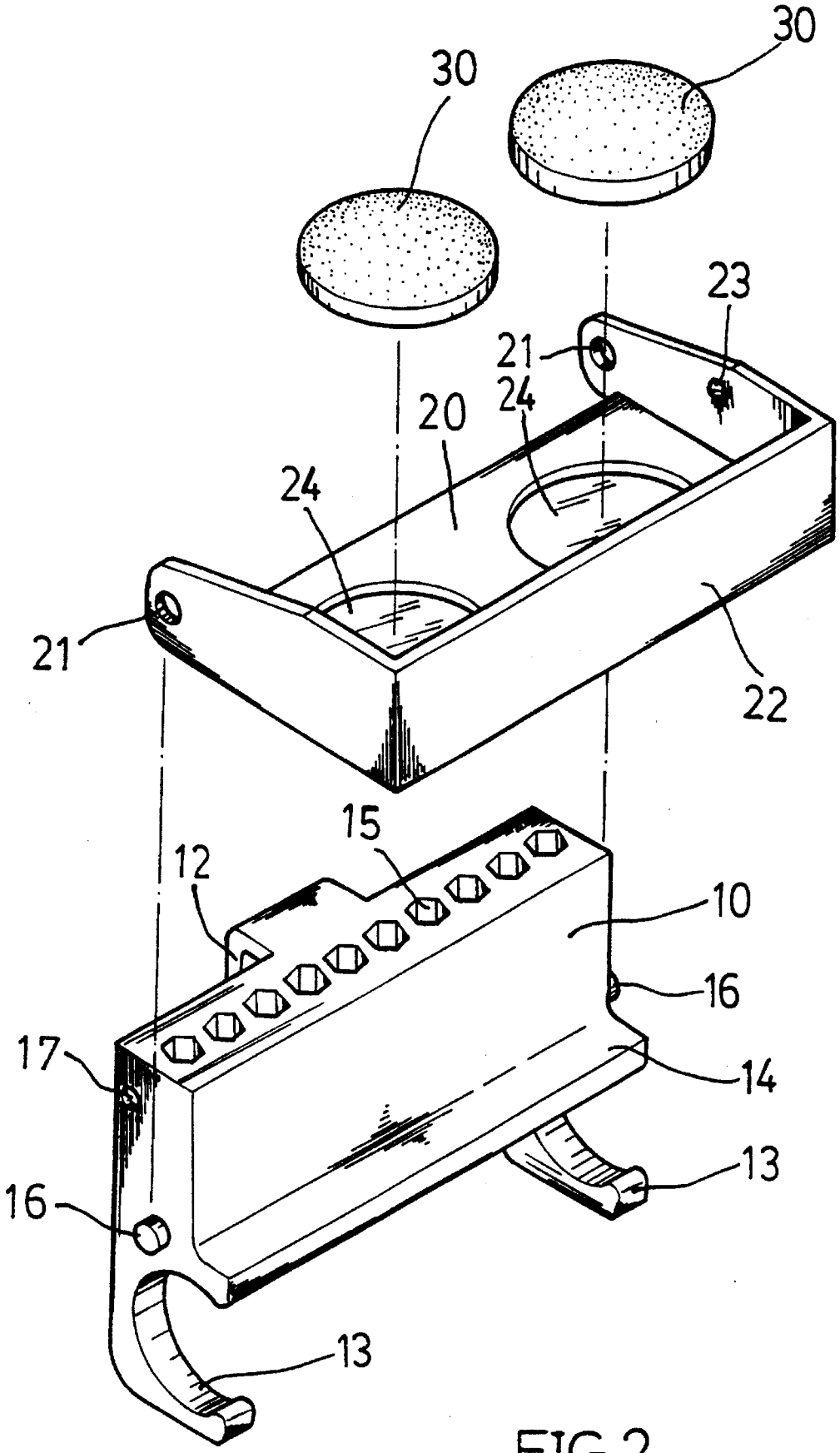
FIG. 2 is an exploded view of a tool case according to the present invention.
Figure 3:
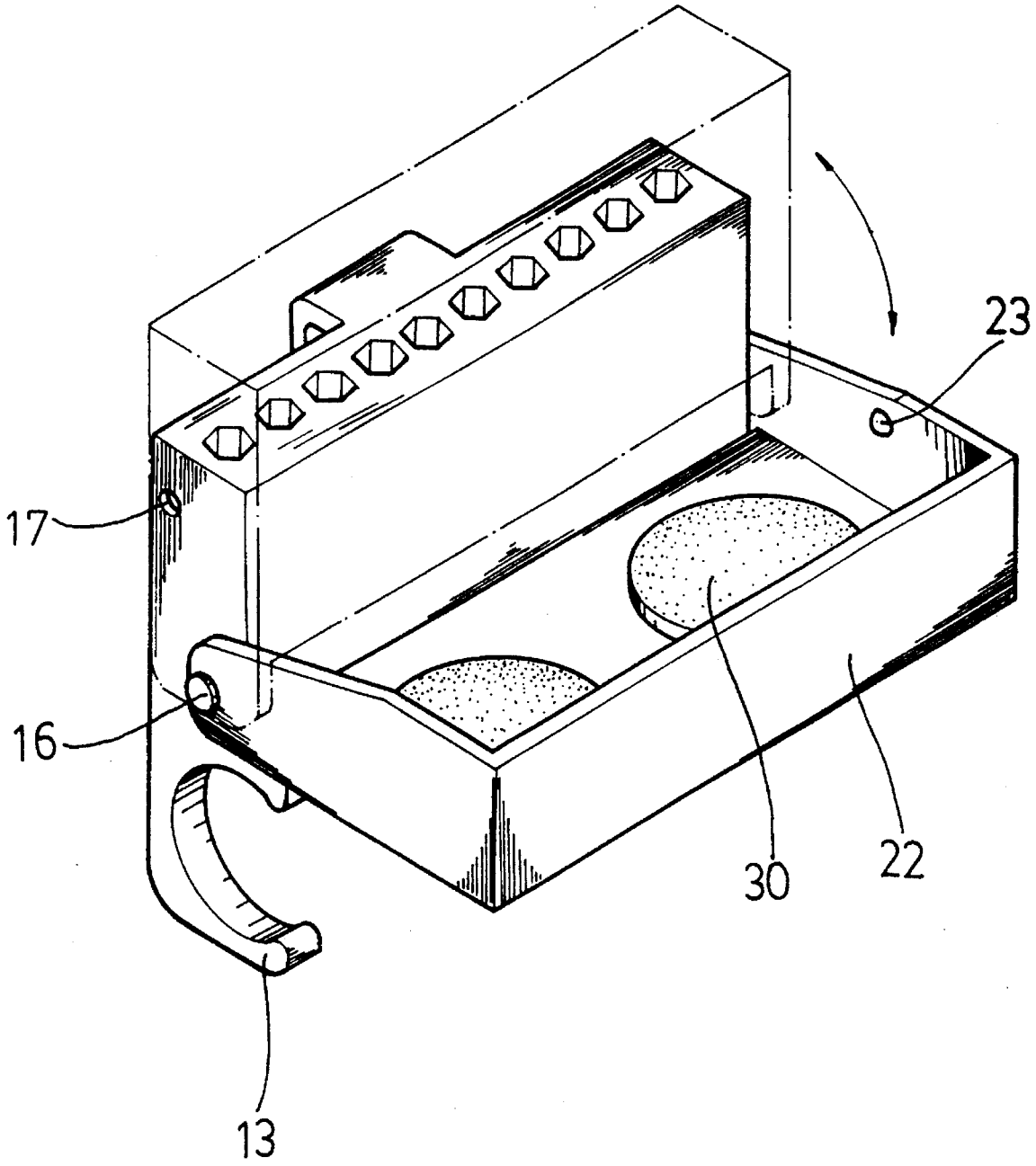
FIG. 3 is an elevational view of the tool case shown in FIG. 2, showing the cover turned outwards from the case body and supported on the platform of the case body.
Figure 4:
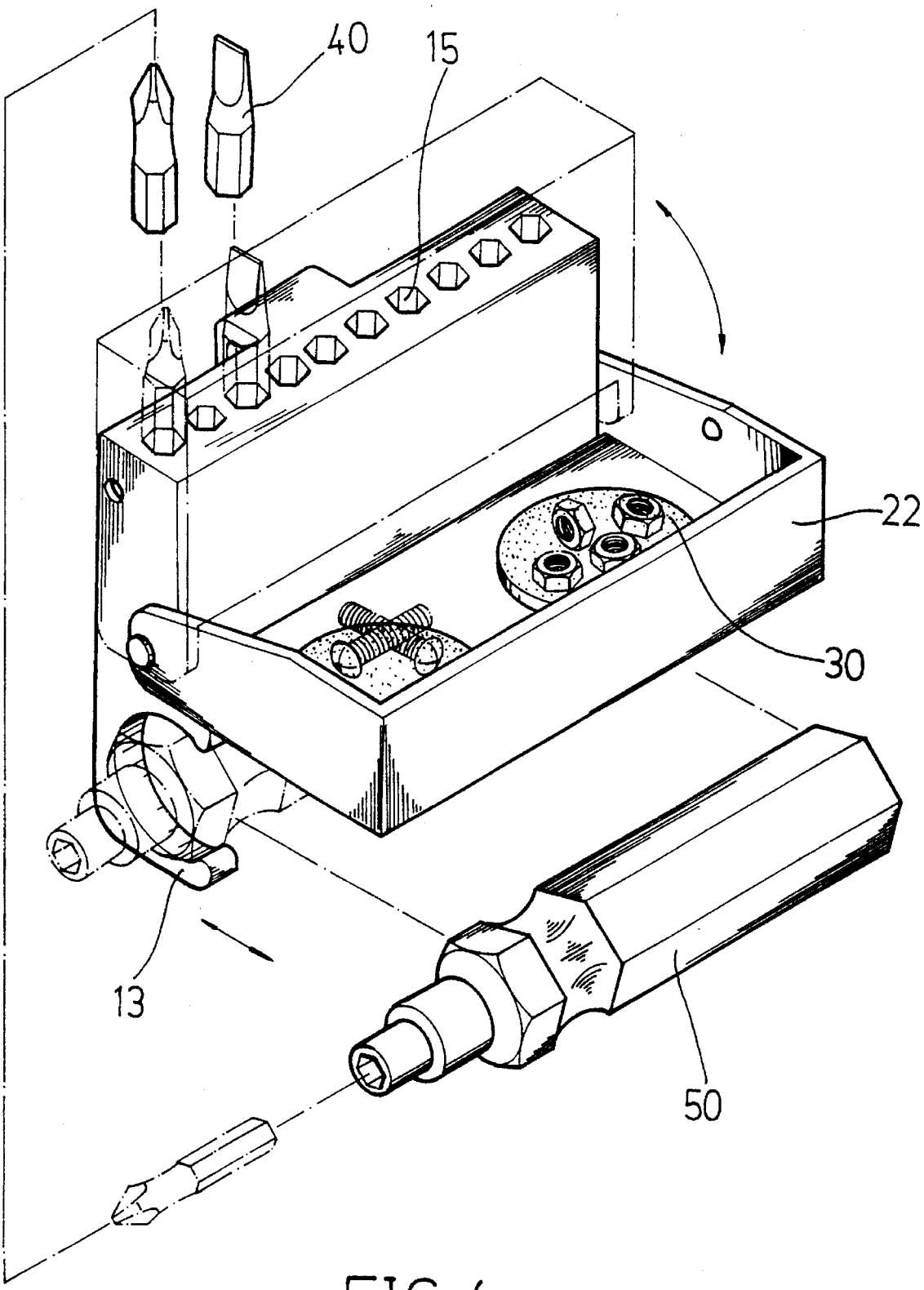
FIG. 4 is an applied view of the present invention.

Referring to FIGS. 2, 3, and 4, a handy tool case in accordance with the present invention is generally comprised of a case body 10, a cover 20, and a plurality of magnetic plates 30. The case body 10 is made of substantially rectangular shape having a plurality of hexagonal chambers 15 at the top side thereof for holding a variety of tool bits 40, two springy hooks 13 disposed at the two opposite ends of the bottom side thereof for holding a tool handle 50, a platform 14 perpendicularly and outwardly extended from the front side thereof for supporting the cover 20, two opposite pivot pins 16 at two opposite lateral sides thereof for mounting the cover 20, and two opposite retaining holes 17 respectively spaced above the pivot pins 16 for holding the cover 20 in the closed position, and a clip 12 at the back side thereof for hanging on the user's belt 60. The cover 22 is pivotably connected to the case body 10 and turned between the close position covered over the tool bits 40 in the hexagonal chambers 15, and the open position supported on the platform 14. As illustrated, the cover 22 comprises two opposite pivot holes 21 at two opposite lateral sides thereof, which receive the pivot pins 16 of the case body 10 respectively for permitting the cover 22 to be turned between the close position and the open position, two raised portions 23 at the two opposite lateral sides, which are forced into the retaining holes 17 on the case body 10 to hold the cover 22 in the close position when the cover 22 is closed on the case body 10, two recessed portions 24 on the bottom side thereof, which receive a respective magnetic plate 30 for holding dismantled metal accessories by magnetic attraction, and a top side 22, which covers over the tool bits 40 in the hexagonal chambers 15 when the cover 20 is closed on the case body 10.

Figure 5:
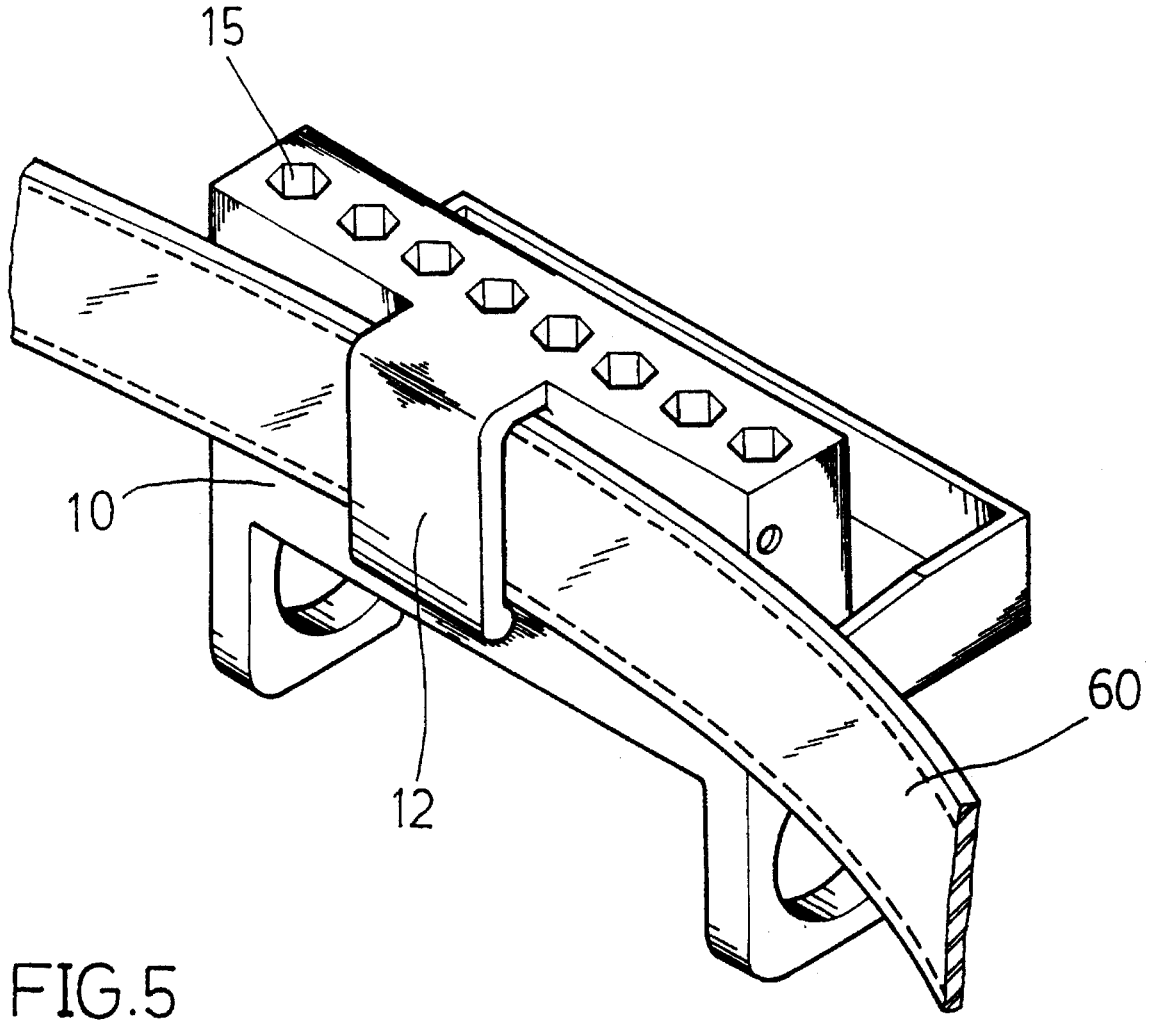
FIG. 5 shows the tool case hung on the belt according to the present invention.

Referring to FIGS. 4 and 5, tool bits 40 are received in the hexagonal chambers 15, a tool handle 50 which is to be used with the tool bits 40 is retained to the springy hooks 13, and two magnetic plates 30 are respectively fitted into the recessed portions 24 on the cover 20. When in use, metal accessories which are dismantled from machine parts can be placed on the magnetic plates 30 in the recessed portions 24 of the cover 20 (see FIG. 4). When the handy tool case is closed, it can be hung on the user's belt 60 as shown in FIG. 5. When in use, the tool handle 50 is removed from the springy hooks 13, then the cover 20 is turned outwards from the close position to the open position and supported on the platform 14, and then the desired tool bit 40 is selected and picked up from the respective hexagonal chamber 15 on the case body 10 and then attached to the tool handle 50 for driving metal accessories such as screws, nuts, etc. The dismantled metal accessories are placed on the magnetic plates 30. After the work, the tool handle 50 and the tool bits 40 are put back into position, and the cover 20 is closed on the case body 10 again.

As indicated, the handy tool case is a three-dimensional design which is compact and can be conveniently carried by the user by handing the clip 12 on the user's belt. Because the tool bits 40 are kept in the hexagonal chambers 15 at the top side of the case body 10, the user can pick up the desired tool bit from the case body 10 when the tool case is hung on the belt. Furthermore, the installation of the magnetic plates 30 keep dismantled metal accessories in place, therefore dismantled metal accessories will not miss.

It is to be understood that the drawings are designed for purposes of illustration only, and are not intended as a definition of the limits and scope of the invention disclosed.

I claim:

1. A handy tool case comprising:

a case body made of substantially rectangular shape having a plurality of hexagonal chambers at a top side thereof for holding a variety of tool bits, two springy hooks disposed at two opposite ends of a bottom side thereof for holding a tool handle outside said case body, a platform perpendicularly and outwardly extended from a front side thereof, two opposite pivot pins and two opposite retaining holes at two opposite lateral sides thereof at different elevations, and a clip at a back side thereof for hanging on the user's belt or a supporting means;

a cover pivotably connected to said case body and turned between a close position covered over the tool bits in said hexagonal chambers and an open position supported on said platform, said cover comprising two opposite pivot holes at two opposite lateral sides thereof, which receive the pivot pins of said case body respectively for permitting said cover to be turned between said close position and said open position, two raised portions at the two opposite lateral sides of said cover, said raised portions being forced into the retaining holes on said case body to hold said cover in said close position when said cover is closed on said case body, at least one recessed portion on a bottom side thereof, and a top side, the top side of said cover being covered over the tool bits in said hexagonal chambers when said cover is closed on said case body, or supported on said platform of said case body when said cover is turned to said open position; and at least one magnetic plates respectively fitted into the at least one recessed portion on said cover for keeping metal accessories by magnetic attraction.

* * * * *